United States Patent [19]

Connell

[11] 3,992,929

[45] Nov. 23, 1976

[54] SPLIT MANDREL

[75] Inventor: Gordon Sidney Connell, Cheltenham, England

[73] Assignee: Formflo Limited, Cheltenham, England

[22] Filed: July 21, 1975

[21] Appl. No.: 597,740

[30] Foreign Application Priority Data

July 24, 1974 United Kingdom ..... 32786/74

[52] U.S. Cl. ..... 72/106; 72/110; 72/105

[51] Int. Cl.[2] ..... B21H 1/12

[58] Field of Search ..... 72/102, 105, 106, 107, 72/108, 110

[56] References Cited

UNITED STATES PATENTS

| | | | |
|---|---|---|---|
| 186,810 | 1/1877 | Davis | 72/106 |
| 1,406,895 | 2/1922 | Reifurth | 72/106 |
| 2,160,866 | 6/1939 | Hothersall | 72/105 |
| 3,631,704 | 1/1972 | Leonard et al. | 72/102 |
| 3,803,890 | 4/1974 | Connell | 72/107 |

FOREIGN PATENTS OR APPLICATIONS

| | | | |
|---|---|---|---|
| 441,237 | 3/1944 | Italy | 29/159.2 |

*Primary Examiner*—Lowell A. Larson
*Attorney, Agent, or Firm*—Pollock, Vande Sande & Priddy

[57] ABSTRACT

A rolling machine for rolling an annular workpiece. The machine includes a mandrel for supporting the workpiece. The mandrel has two co-operating sections separated across its axis and a part of each section is shaped to conform to the rolled profile of a part of the workpiece.

6 Claims, 2 Drawing Figures

SPLIT MANDREL

This invention relates to improvements in rolling machines for rolling annular workpieces to a desired profile.

BACKGROUND TO THE INVENTION

When rolling an annular workpiece to shape the workpiece is rotatably supported on a mandrel. The mandrel can be in the form of a metal shaft onto which an annular workpiece is slid before rolling starts. The diameter of the mandrel is such that it allows the workpiece to slide freely onto the mandrel, but, as soon as the rolls are rotated and moved towards each other they squeeze the workpiece between themselves and the mandrel and the workpiece is forced into contact with the mandrel so causing the two to rotate together.

One of the drawbacks with this system is that only the outer surface of the workpiece can be formed in a single operation. The forming of the side chamfers must be carried out in a further machining operation. Also some form of opposed springs are needed to locate the workpiece accurately on the mandrel.

BRIEF DESCRIPTION TO THE INVENTION

In order to obviate these and other disadvantages there is provided according to the invention a rolling machine for rolling an annular workpiece, which machine includes a mandrel for supporting the workpiece, the mandrel having two co-operating sections separated across the mandrel axis, a part of each section being shaped to conform to the rolled profile of a part of the workpiece; at least one forming roll; and means for limiting separation of the mandrel sections during rolling.

The two mandrel sections can be urged together, after the workpiece has been loaded, by for example hydraulic or pneumatic means or by the use of springs.

The quality of the rolled workpiece can depend on where the mandrel is split into its sections. The force exerted by the forming rolls on the workpiece is greatest where the forming part of the rolls contacts the workpiece. If the split is situated in this region there would be, on rolling, a tendency for the workpiece material to flow into the gap made by the split. Therefore to obviate this the split is situated away from this region and towards the edge of the workpiece.

BRIEF DESCRIPTION TO THE DRAWINGS

The invention will now be described by way of example with reference to the accompanying drawings in which.

DESCRIPTION OF THE PREFERRED EMBODIMENTS

Figure 1:
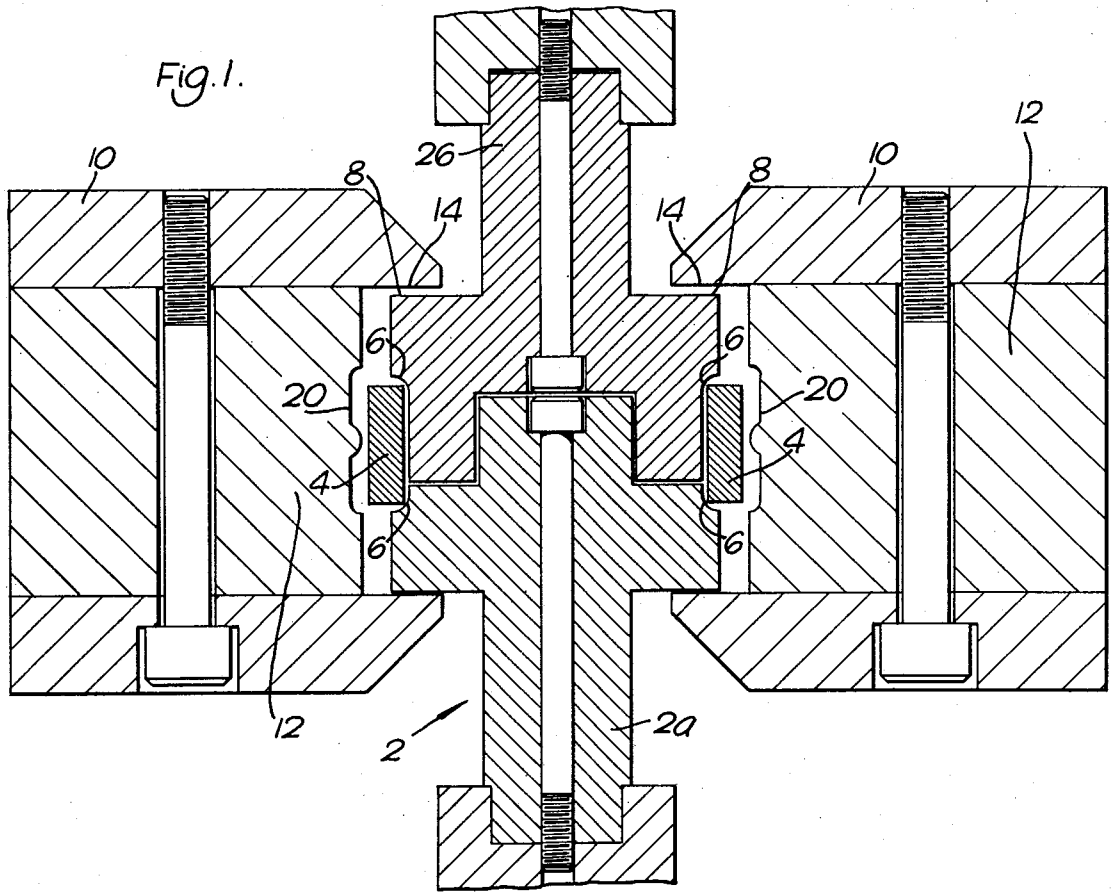
FIG. 1 shows the position of a mandrel in a rolling machine before rolling has started.

Referring to FIG. 1 the mandrel is shown as comprising two sections 2*a* and 2*b*. The workpiece 4 to be rolled is initially loaded onto section 2*b*, then section 2*a* is coupled with section 2*b*. In coupling the two sections together the ring workpiece 4 is constrained between the sides 6 of the two parts of the mandrel, thereby ensuring that the workpiece is axially aligned with the mandrel.

Axially spaced slightly from the flanks 8 of the mandrel 2 are sideplates 10, which when the workpiece 4 is rolled absorb the transmitted rolling forces acting along the axis of the mandrel.

After the workpiece 4 has been loaded and the mandrel sections coupled together, forming rolls 12 advance towards each other and roll form a ring. When the forming rolls initially contact the workpiece 4 it is squeezed radially and causes the mandrel sections 2*a* and 2*b* to move axially apart until each section presses on the inner face 14 of the side plates 10. At this point it is ensured that the internal and external forms are accurately aligned. Also the deformation of the workpiece 4 results in it acquiring the chamfered shape of the formed faces of the mandrel.

Figure 2:
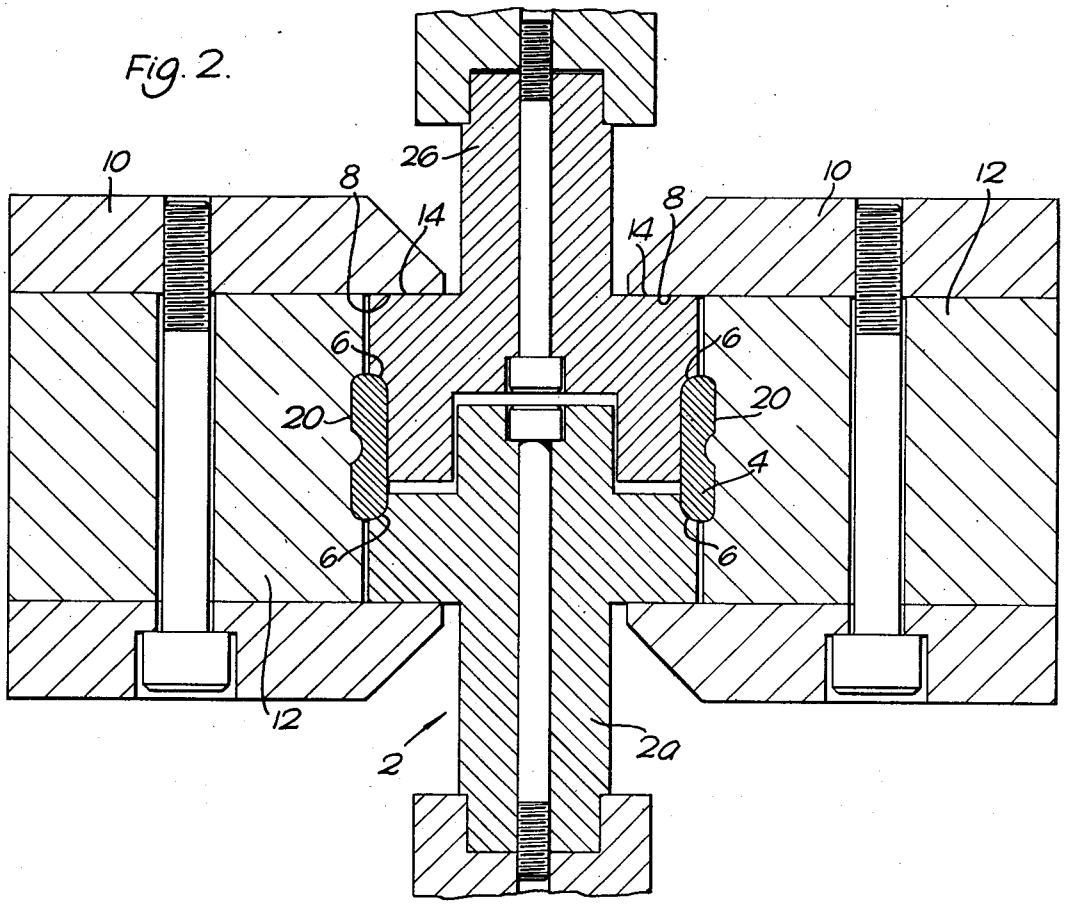
FIG. 2 shows the position of the split mandrel in the rolling machine after rolling has been completed.

FIG. 2 shows the ring in its rolled state and the mandrel pressing against the inner faces 14 of the sideplates 10. As the sideplates 10 are fixed the distance that the mandrel sections can move apart under the influence of the axial deformation force exerted by the blank is limited by the initial space between the faces 14 and the mandrel flanks 8.

This force is greatest in the region where the forming part 20 of the rolls contacts the workpiece and at the extreme edges where the corner radii 6 are formed. Between these high force points the force is relatively low and the gap between the two mandrel sections must always be situated in the low force region. If the gap were situated in the high force region some material could be squeezed into the gap.

I claim:

1. A rolling machine for roll forming inner and outer profiles of a workpiece, which machine comprises:

a. a mandrel for supporting said workpiece during rolling and having a forming surface for shaping the inner profile of said workpiece, said mandrel having two separate sections which can be separated during rolling to define said forming surface with a portion of said forming surface on each of said sections and which can be separated at a joint within said forming surface after rolling the workpiece to release the formed workpiece, b. two oppositely disposed forming rolls having formed in the periphery thereof a second forming surface shaped to conform to the rolled outer profile of said workpiece, c. means for advancing said forming rolls towards one another to roll form a workpiece, d. means for restricting the separation of said mandrel sections during rolling including side edges on said mandrel and annular flanges projecting radially outwardly at either side of said forming rolls to engage and embrace said side edges on said mandrel as said forming rolls advance, wherein said joint within said forming surface of said mandrel sections is located at a part of said forming surface that experiences relatively low rolling forces.

2. A rolling machine as claimed in claim 1 in which the axial extremities of said sections of said mandrel which define said forming surface are curved to provide chamfers on said workpiece.

3. A rolling machine according to claim 1, in which said means for restricting the separation of said mandrel sections additionally includes hydraulic means for urging said mandrel sections together.

4. A rolling machine according to claim 1 in which said means for restricting the separation of said mandrel sections additionally includes pneumatic means for urging said mandrel sections together.

5. A rolling machine according to claim 1 in which said means for restricting the separation of said mandrel sections additionally includes spring means for urging said mandrel sections together.

6. A rolling machine as claimed in claim 1 in which said annular flanges projecting radially outwardly at either side of said forming rolls are side plates attached to either side of said forming rolls.

* * * * *